US007624746B2

(12) United States Patent
Blake

(10) Patent No.: US 7,624,746 B2
(45) Date of Patent: Dec. 1, 2009

(54) ADJUSTABLE CANE WITH ENHANCED GRASPING MECHANISM, MAGNETIC PICKUP, HANGING TIP AND SELF-STANDING BASE

(75) Inventor: Charles Blake, Jacksonville, FL (US)

(73) Assignee: Canes & Distinctive Inventions, Inc., Jacksonville, FL (US)

( * ) Notice: Subject to any disclaimer, the term of this patent is extended or adjusted under 35 U.S.C. 154(b) by 36 days.

(21) Appl. No.: 11/950,415

(22) Filed: Dec. 4, 2007

(65) Prior Publication Data

US 2008/0128009 A1 Jun. 5, 2008

Related U.S. Application Data

(60) Provisional application No. 60/868,723, filed on Dec. 5, 2006.

(51) Int. Cl.
*A45B 3/00* (2006.01)

(52) U.S. Cl. ..... 135/65; 135/66; 135/70; 135/80; 135/84; 294/19.1

(58) Field of Classification Search ..... 135/65–6, 135/69–70, 72, 77–81, 846; 294/19.1, 19.3, 294/50.6, 50.9; 248/155, 188.9
See application file for complete search history.

(56) References Cited

U.S. PATENT DOCUMENTS 2,346,038 A * 4/1944 Mason ..... 294/19.1
3,105,715 A * 10/1963 Happ ..... 294/61
4,200,322 A * 4/1980 Smith ..... 294/19.1
5,392,800 A * 2/1995 Sergi ..... 135/65
5,640,985 A * 6/1997 Snyder et al. ..... 135/65
6,550,490 B1 * 4/2003 Morton et al. ..... 135/66
7,243,668 B1 * 7/2007 Kroeze ..... 135/77
7,252,104 B1 * 8/2007 Anderwald ..... 135/65
2004/0255995 A1 * 12/2004 Garrett ..... 135/66
2006/0266397 A1 * 11/2006 Berl ..... 135/70

FOREIGN PATENT DOCUMENTS

DE 4337298 A1 * 5/1995

* cited by examiner

*Primary Examiner*—Winnie Yip
(74) *Attorney, Agent, or Firm*—Mark Young, P.A.

(57) ABSTRACT

An adjustable cane includes a grasping mechanism, an actuator, an adjustable length inelastic linkage, a magnetic pickup, hanging tip and self-standing base. Pivotally mounted to the distal end of the cane, the grasping mechanism includes a pair of fingers defining a narrow valley for grasping small objects and a wide valley for grasping large objects. The adjustable length inelastic linkage transmits force from the actuator to the grasping mechanism. The magnetic pickup is mounted to the grasping mechanism to facilitate retrieval of ferrous objects. The hanging tip supports the cane from horizontal surfaces. The self-standing base allows the cane to stand upright on any flat surface.

19 Claims, 9 Drawing Sheets

ADJUSTABLE CANE WITH ENHANCED GRASPING MECHANISM, MAGNETIC PICKUP, HANGING TIP AND SELF-STANDING BASE

RELATED APPLICATION

This application claims the benefit of priority of U.S. provisional application 60/868,723, filed Dec. 5, 2006, the entire contents of which are incorporated herein by this reference.

FIELD OF THE INVENTION

This invention generally relates to canes, and more particularly, to an adjustable cane with an adjustable length inelastic linkage, a grasping mechanism, magnetic pickup, hanging tip and self-standing base.

BACKGROUND

Canes are well known for providing support and stability for individuals having difficulty walking. Unfortunately, many individuals who require the use of a cane for walking lack an ability to bend over and retrieve small objects from the ground. Consequently, a number of canes have been devised with grasping devices and actuation mechanisms to assist an individual using the cane in reaching and retrieving objects.

While canes equipped with gripping mechanisms represent improvements over conventional canes, they suffer several shortcomings. For example, U.S. Pat. Nos. 5,392,800, 5,636,650 and 5,640,985 all describe hollow canes in which tension applied to a cable extending within the hollow cane body causes a grasping arm pivotally mounted near the lower rubber tip of the can to pivot inward, closing a gap against the rubber cane tip to grasp an object, with a spring also attached to the grasping arm being used to pivot the grasping arm outward, away from the cane tip, and to maintain tension within the cable. In the device of U.S. Pat. Nos. 5,392,800 and 5,640,985, the cable is pulled by pivoting a lever near the handle of the cane. In the device of U.S. Pat. No. 5,636,650, the cable is pulled by sliding a finger grip located below the cane handle, and a system of pulleys slidably mounted within the cane provides for operation of the grasping arm after the length of the cane is varied by sliding one tube within another.

While such canes equipped with gripping mechanisms are an improvement over conventional canes without any gripping tool, they suffer some shortcomings. For example, such canes are not readily adjustable.

Changing the height of the cane to accommodate individuals of different heights is laborious and difficult. As another example of a shortcoming, the gripping mechanisms interfere with normal use of the cane.

Yet another shortcoming is that the gripping members are not particularly well designed for grasping small objects such as a card or sheet of paper, a coin or a key. A further shortcoming is an inability to stand upright or hang from a support surface. If a conventional cane falls, the user must bend to retrieve it.

Moreover, the gripping force of such prior art canes is limited by elastic tensile members in the linkage or resilient gripping fingers. This provides a substantial disadvantage when using the device to lift relatively heavy objects.

Accordingly, a need exists for an adjustable cane with an inelastic adjustable length linkage, enhanced grasping mechanism, magnetic pickup, hanging tip and self-standing base. This invention is directed to overcoming one or more of the problems and solving one or more of the needs as set forth above.

SUMMARY OF THE INVENTION

An adjustable cane is adapted to facilitate standing upright, hanging on an edge and picking up objects from the floor. The adjustable cane has a proximal end with a handle and a distal end with a base. A biased grasping mechanism with non-slip surfaces and gripping fingers are provided at the distal end of the cane. A magnetic pickup is attached to the grasping mechanism. An actuator at the proximal end of the cane is operably coupled to said grasping mechanism by an adjustable length mechanical linkage assembly. A hanging tip is attached to the actuator. A self-standing base is provided at the distal end of the cane.

In one aspect of the invention, an adjustable length manually actuated grasping walking cane includes a handle and an adjustable length body attached to the handle. The adjustable length body has a distal end and an actuator movably coupled proximate to the handle. The actuator has a distal end. An inelastic adjustable length linkage is provided within the adjustable length body. The inelastic adjustable length linkage has proximal and distal ends. The proximal end of the inelastic adjustable length linkage is attached to the distal end of the actuator. A pivoting grasping member is pivotally attached near the distal end of the adjustable length body. The inelastic adjustable length linkage is operably coupled to the pivoting grasping member and causes the pivoting grasping member to pivot when the actuator is actuated.

In another aspect of the invention, an exemplary actuator features a handle portion configured for actuation by urging towards the handle. The adjustable length body includes an actuator aperture. The distal end of the actuator is bent and offset to connect to the inelastic adjustable length linkage within the adjustable length body via the actuator aperture. The inelastic adjustable length linkage includes a coupling and a cable. The coupling has distal and proximal ends. The cable has distal and proximal ends. The proximal end of the coupling is attached to the distal end of the actuator. The distal end of the coupling is attached to the proximal end of the cable. The distal end of the cable is attached to the grasping member. The grasping member may have roughened grasping surfaces.

In yet another aspect of the invention, an exemplary grasping member includes a hub and arm. The distal end of the cable is attached to the hub of the grasping member and configured to transmit a tensile force from the actuator, through the coupling, through the cable and to the hub of the grasping means. The tensile force causes the grasping means to pivot. The grasping member further including a plurality of grasping fingers protruding from the arm, near the free end of the arm in spaced relation and configured to define a generally u- or v-shaped narrow (<1 inch) space between the pair of grasping fingers. The grasping fingers have filleted tips. A generally u- or v-shaped wide (>2 inch) space is defined between the hub and the pair of grasping fingers. A return spring is operably coupled to the hub and configured to urge the grasping member to a closed position.

In yet another aspect of the invention, the grasping member further includes a magnet configured to attract ferrous materials.

In yet a further aspect of the invention, a broad base is provided to support the cane upright. The broad base is attached to the distal end of the cane body.

In still a further aspect of the invention, a light source assembly mounted in the free end of the handle and a switch for controlling the light source is mounted on the handle.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the invention is not limited to the exemplary embodiments depicted in the figures or the shapes, relative sizes, proportions or materials shown in the figures.

DETAILED DESCRIPTION

The invention provides an adjustable cane with a grasping mechanism, an actuator, an adjustable length inelastic linkage, a magnetic pickup, hanging tip and self-standing base. Pivotally mounted to the distal end of the cane, the grasping mechanism includes a pair of fingers defining a narrow valley for grasping small objects and a wide valley for grasping large objects. The adjustable length inelastic linkage transmits force from the actuator to the grasping mechanism. The magnetic pickup is mounted to the grasping mechanism to facilitate retrieval of ferrous objects. The hanging tip supports the cane from horizontal surfaces. The self-standing base allows the cane to stand upright on any flat surface.

Figure 1:
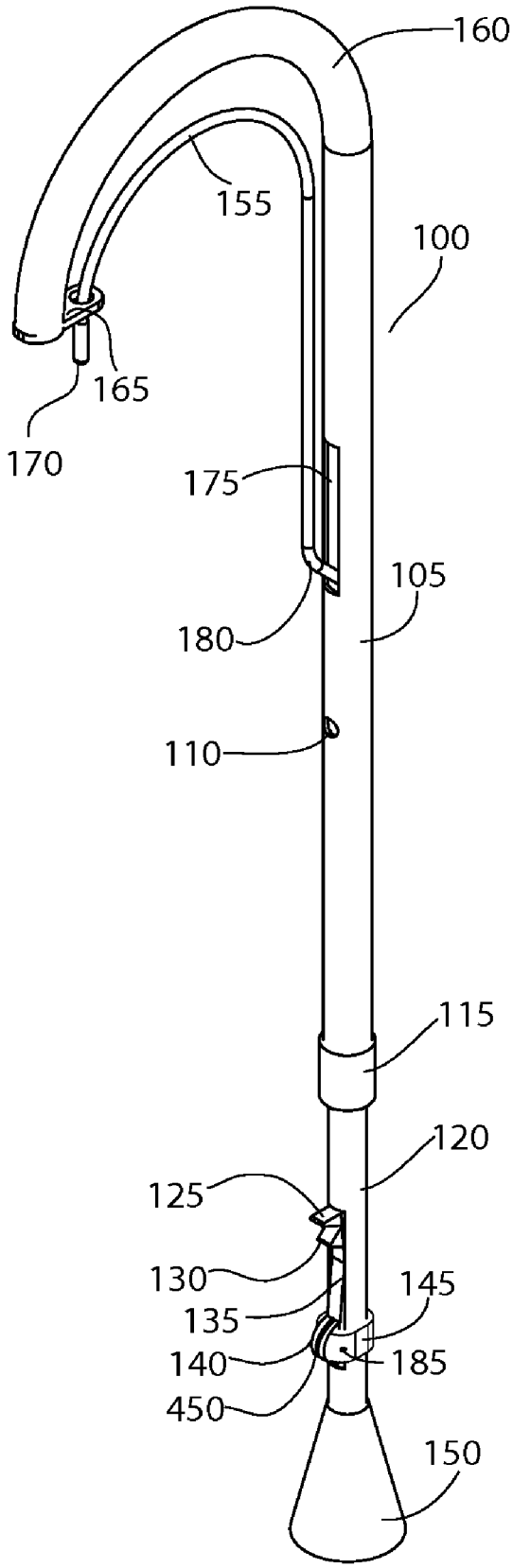
FIG. 1 is a front side perspective view of an exemplary cane with an inelastic adjustable length linkage, enhanced grasping mechanism, magnetic pickup, hanging tip and self-standing base in accordance with principles of the invention.
Figure 2:
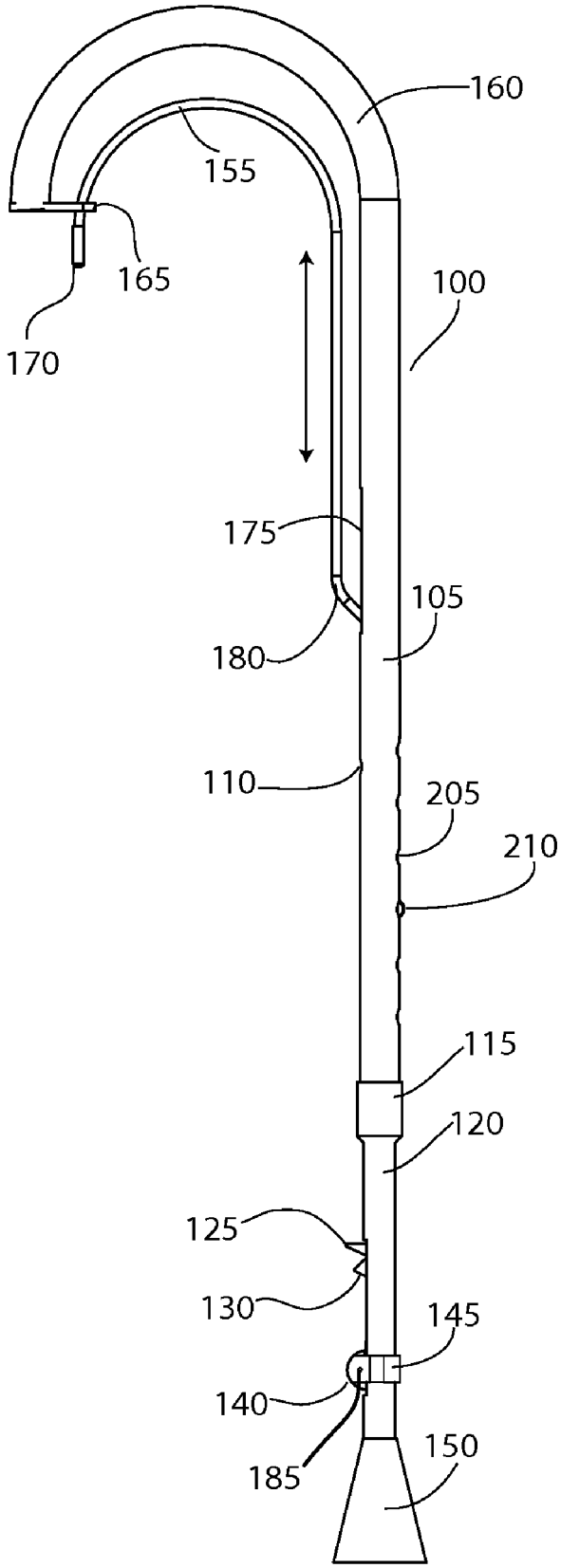
FIG. 2 is a side plan view of an exemplary cane with an inelastic adjustable length linkage, enhanced grasping mechanism, magnetic pickup, hanging tip and self-standing base in accordance with principles of the invention.
Figure 4:
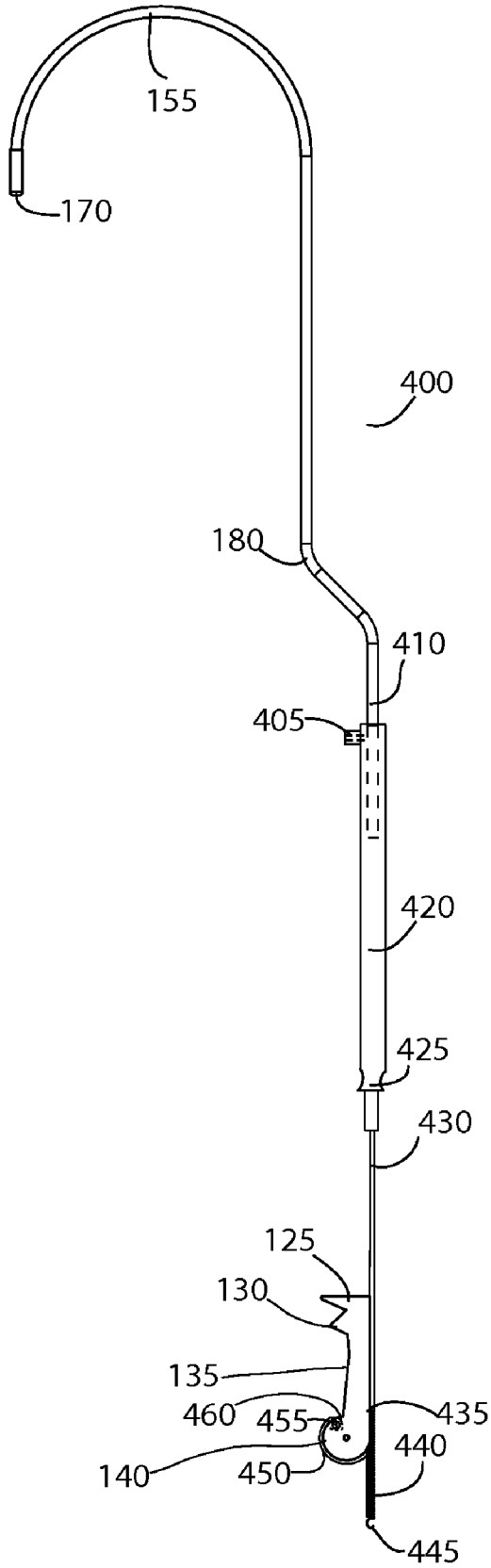
FIG. 4 is a plan view of an exemplary inelastic adjustable length linkage assembly, grasping mechanism and return spring in accordance with principles of the invention.

Referring now to FIGS. 1 and 2, perspective and side views of an exemplary cane 100 with a grasping member 125, magnetic pickup 510 (shown in FIG. 5), hanging tip 170 and self-standing base 150 in accordance with principles of the invention are provided. The cane 100 is generally comprised of a pair of telescopically arranged tubular segments 105, 120, a handle 160, an actuator 155 operably coupled to a grasping member 125 by a linkage assembly 400 (as shown in FIG. 4). The grasping member 125 is pivotally mounted with a clamp 145 to the bottom segment 120 of the cane 100. The cane also has a broad base 150.

The exemplary actuator 155 is configured to move between a released resting point furthest away from the handle 160 to an actuated point closest to the handle 160. An actuator guide 165 comprising a bracket, extends from the free end of the handle 160 towards the actuator 155. The actuator guide 165 guides movement of actuator 155 throughout the range of motion of the actuator 155. When the actuator 155 is actuated, i.e., urged (e.g., squeezed) towards the handle 160, movement of the actuator 155 towards the handle 160 causes corresponding movement of the linkage assembly 400 (as shown in FIG. 4 and discussed below). The linkage assembly 400 is contained within the tubular members 105, 120 comprising the cane 100. A slot 175 in the top portion of the cane 105 allows the actuator 155 to connect to the internal linkage assembly 400 and travel throughout the full range of motion of the actuator 155. A bend 180 at the distal end of the actuator 155 passes through the slot 175. Corresponding movement of the linkage assembly 400 causes the grasping member 125 to pivot about a pivotal mounting axis 185, so that the free end 130 of the grasping member swings toward the base 150 of the cane 100, until the grasping member 125 hits an obstacle or the base 150 of the cane 100. The grasping member 125 remains in an actuated state until the actuator is released. When the actuator 155 is in a released (i.e., un-squeezed) position, the grasping member 125 is pivotally urged by a biasing member 440 (as shown in FIG. 4) into a slot or compartment 505 (shown in FIG. 5), defined near the distal end of the bottom segment 120. The grasping member 125 is actuated by moving the actuator 155 towards the cane handle 160, guided by a bracket 155. An extendable biased mechanical linkage (discussed below) translates motion of the actuator 155 into motion of the grasping member 125.

The cane provides means for self-support. Advantageously, the base 150 features a broad footprint. The exemplary cane stands upright on the broad base 150 without support from any other structure. The principles of the invention apply to canes with one foot, as well as to canes with a plurality of feet, all of which are intended to come within the scope of the invention.

Additionally, a hanging tip 170 is provided on the free end of the actuator 155. The tip 170 may be comprised of a protective polymeric (e.g., vinyl) end cap. The hanging tip 170 allows the cane to be suspended in a balanced state from the edge of a planar surface, such as a table or countertop. Friction between the tip 170 and the planar surface prevents the tip from sliding off the planar surface. The tip 170 also protects the planar surface from damage (e.g., scratching) by the actuator 155.

Figure 3:
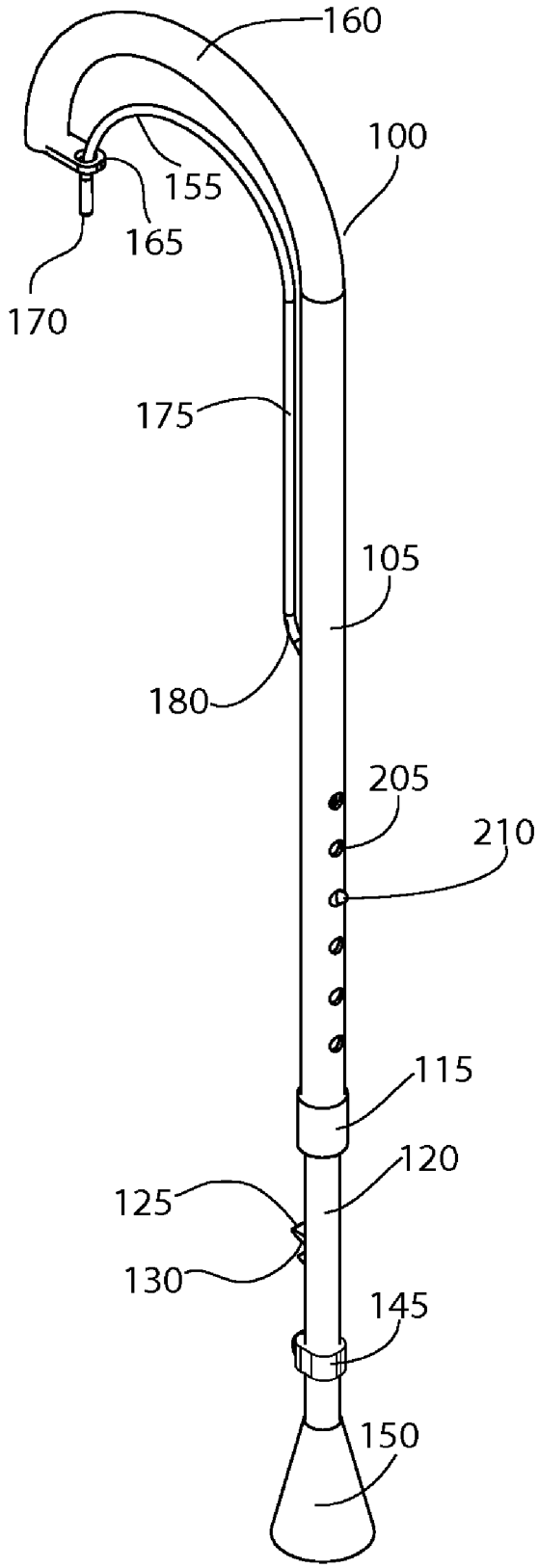
FIG. 3 is a rear side perspective view of an exemplary cane with an inelastic adjustable length linkage, enhanced grasping mechanism, magnetic pickup, hanging tip and self-standing base in accordance with principles of the invention.

In an exemplary embodiment, the cane is adjustable in length. Illustratively, a top segment 105 receives part of a bottom segment 120. The top segment 105 has an inner diameter that is slightly larger than the outer diameter of the bottom segment 120. It also includes a plurality of holes 205 configured for releasable engagement of a biased projection 210 attached to the bottom segment 120, as shown in FIG. 3. The biased projection is a protruding button 210 connected to a leaf spring on the inside of the bottom segment. A proximal end of the bottom segment 120 may be inserted into the distal end of the top segment 105. When the bottom segment 120 is inserted far enough and rotated so that the biased projection 210 aligns with one of the corresponding holes 205 in the top segment 105, the protruding end of the biased projection 210 passes through the aligned hole 205, thereby locking the bottom segment 120 to the top segment 105. A collar 115 is also provided to threadedly engage the distal end of the top segment 105. The collar 115 may act as a compression fitting. Thus, tightening the collar 115 increases frictionally engagement between the top and bottom segments 105, 120. To adjust length of the cane 100, a threaded collar 115 is loosened, the biased projection 210 is depressed to disengage the hole, and the bottom segment 120 is adjusted relative to the top segment 105. Upon achieving the desired length and proper alignment, the biased projection 210 is released to engage an aligned corresponding hole 205, and the threaded collar 115 is tightened. Tightening the threaded collar 115 compresses the distal end of the top segment 105, thereby securely gripping the bottom segment 120.

A linkage assembly 400, as shown in FIG. 4, transmits motion of the actuator 155 to the grasping member 125. In an exemplary embodiment, the linkage assembly 400 of the cane 100 is adjustable in length. The exemplary linkage assembly 400 includes a coupling 420 attached at one end (i.e., the proximal end) 410 to the actuator 155 and attached at the opposite distal end 425 to a cable 430. The distal end 410 of the actuator 155 is received telescopically in the proximal end of the coupling 420. A fastener assembly 405, which may comprise a threaded fitting and allen screw, secures the portion of the actuator 155 received by the coupling 420 in a desired position relative to the coupling 420. The fastener assembly 405 readily allows adjustment of the length of the combined actuator 155 and coupling 420. In the exemplary embodiment, the coupling 420 and distal end 410 of the actuator 155 reside fully or substantially within the top segment 105 of the cane 100, while the cable 430 resides fully or substantially within the bottom segment 120 of the cane 100. One or more access holes 110 or slots may be provided in the top segment 105 to facilitate access to and adjustment of the fastener assembly 405.

The cable may be metal that is coated or uncoated for improved durability and resistance to the elements. By way of example and not limitation, coated or uncoated stainless steel cable may be used.

To dampen vibrations and muffle sounds produced by rattling, vibrating and shaking components, various insulating materials, dampers, spacers and guides may be included. For example, a resilient spacer sleeve or ring may surround one or more portions of the linkage such as the cable, to prevent the cable from contacting and rattling or vibrating against an interior segment. Alternatively, components may be coated with a sound insulating material. For example, one or more linkage components, and/or the interior surfaces of the tubular segments, and/or the grasping member, and/or other components may be partially or fully coated with a sound deadening and/or vibration damping material, such as a resilient material. Examples of suitable resilient materials include vinyl, rubber, silicon and other elastomers.

The actuator 155 includes a curved handle at the proximal end. The handle generally conforms to the shape of the cane handle 160, except that it features a smaller radius. The handle may be curved, straight, right angled, or any other suitable handle shape. In the exemplary embodiment, the curved handle leads to a proximal shaft and then to a bend 180. The distal end 410 of the actuator 155 is offset from the proximal shaft to fit within the top segment 105 of the cane 100. In use, a non-marring cover 170 may be applied over the free end of the curved handle to prevent damage and to provide a hanging tip.

Advantageously, the exemplary linkage assembly 400 is inelastic, meaning that it neither stretches nor compresses in any material respect in response to exerted forces. Thus, the pickup force exerted by the grasping member 125 is directly (e.g., linearly) related to the force applied to the actuator 155. Barring mechanical failure, the force exerted by the grasping member 125 will increase as the force applied to the actuator 155 increases. Likewise, the force exerted by the grasping member 125 will decrease as the force applied to the actuator 155 decreases. The tensile force on the linkage assembly 400 exerted via the actuator is applied to the periphery of the hub 140 of the grasping member 125, thereby exerting a torque that is directly proportional to the radius of the hub 140. The grasping member 125 is deployed to a grasping position when the tensile force exerted by the linkage assembly 400 exceeds the retraction force exerted by the spring 440.

A cable coupling 455 operably connects the distal end 460 of the cable 430 to a hub 140 of the grasping member 125. A hub portion 450 of the cable 430 wraps around the exposed portion of the hub 140. The distal end 455 of the cable may be a crimped looped end 455. The cable coupling 455 may be a hook, pin, screw or other fastener threadedly received by the hub 140 and adapted to secure the distal end 455 of the cable 430 to the hub. The hub 140 may include cable engaging sections of varied diameters, which may be selectively used to define a particular torque and range of actuator motion.

The proximal end of the cable 430 is attached to the distal end 425 of the coupling 420. The attachment may include crimping, threaded, welding or other mechanical attachment.

Figure 5:
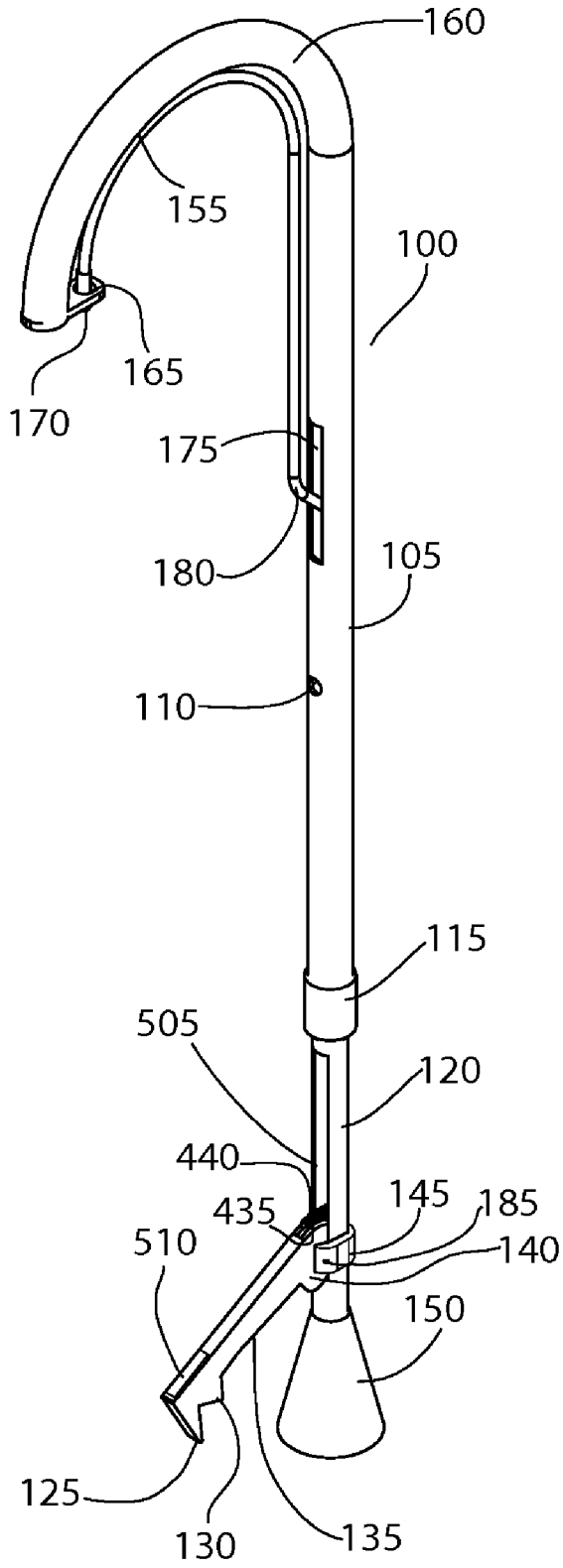
FIG. 5 is a front side perspective view of an exemplary cane with an inelastic adjustable length linkage, enhanced grasping mechanism in a deployed position, magnetic pickup, hanging tip and self-standing base in accordance with principles of the invention.

The hub 140 rotates (i.e., pivots) about an axis defined by a mounting shaft, pin or screw 185. In a preferred embodiment, the cable 430 extends from the distal end 425 of the coupling 420, is wound partially around the hub 140 and attached to the periphery of the hub 140 at a determined position (e.g., the 8, 9 or 10 o'clock position). Actuating the actuator 155 causes the coupling 420 to exert a tensile force pulling on the cable 430, which causes the grasping member 125 to rotate about axis 185. Rotational motion of the hub 140 causes the free end of the grasping member 125 to swing toward the base 150 of the cane 100 (as shown in FIG. 5), until the free end hits an obstacle or the base 150 of the cane 100. The grasping member 125 remains in an actuated state until the actuator 155 is released.

Figure 8:
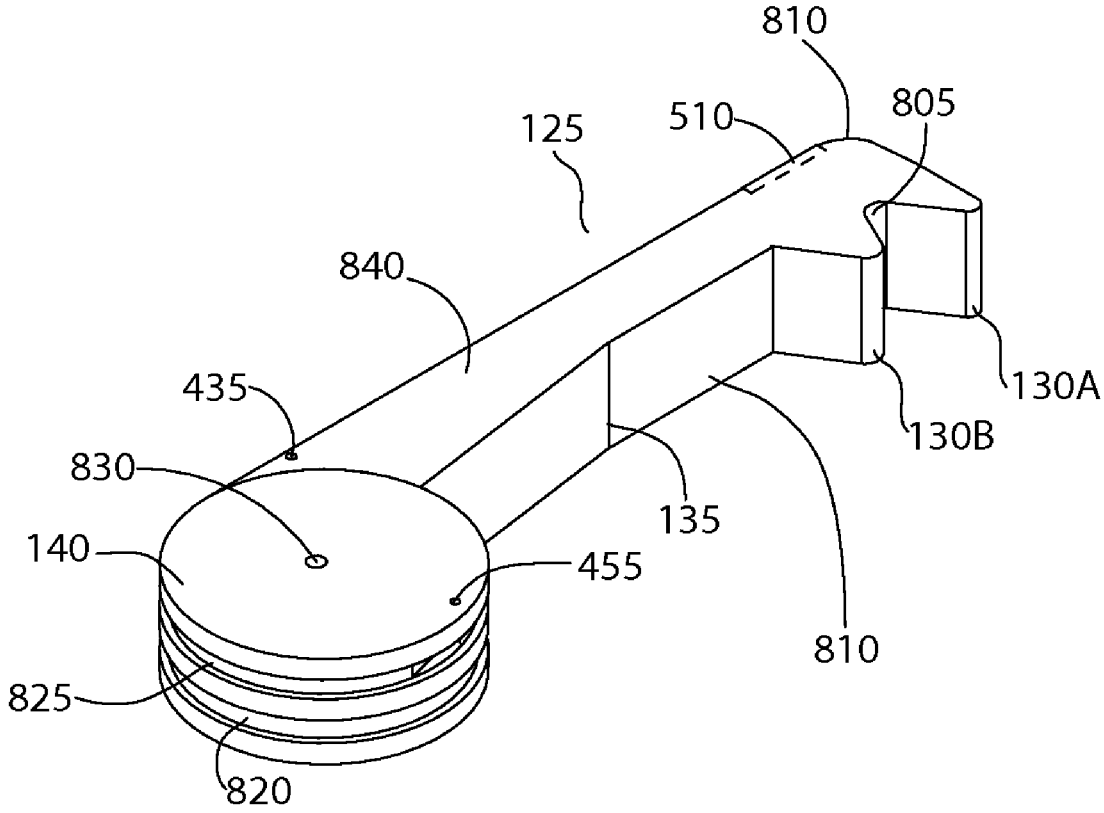
FIG. 8 is a perspective view of an exemplary grasping member according to principles of the invention.

A biasing member, such as tensile return spring 440, causes the grasping member 125 to return to its released un-actuated position when force is relieved from the actuator 155. The distal end 445 of the spring 440 is attached to the interior distal end of the bottom segment 120 of the cane 100. The proximal end 435 of the spring is attached to the periphery of the hub 140 at a determined spring attachment position 435 (e.g., the 1, 2 or 3 o'clock position), as shown in FIGS. 5 and 8. Thus, as actuation causes rotational motion of the hub 140, the spring 440 stretches and exerts a tensile force at the spring attachment position 435, inducing a rotational force in the hub 140 opposite the direction of rotation caused by the actuated actuator 155. When the actuator 155 is relieved, the rotational force of the spring 440 urges the grasping member 125 to its released un-actuated position as shown in FIGS. 1 to 3.

The cable 430 provides a second means of length adjustment, which can be used in addition to or in lieu of the length adjustable coupling 420. A cable 430 of a desired length may be selected and utilized to provide a desired overall length to the linkage assembly 400. An adjustable length cable 430 may also be used to provide length adjustability.

Figure 6:
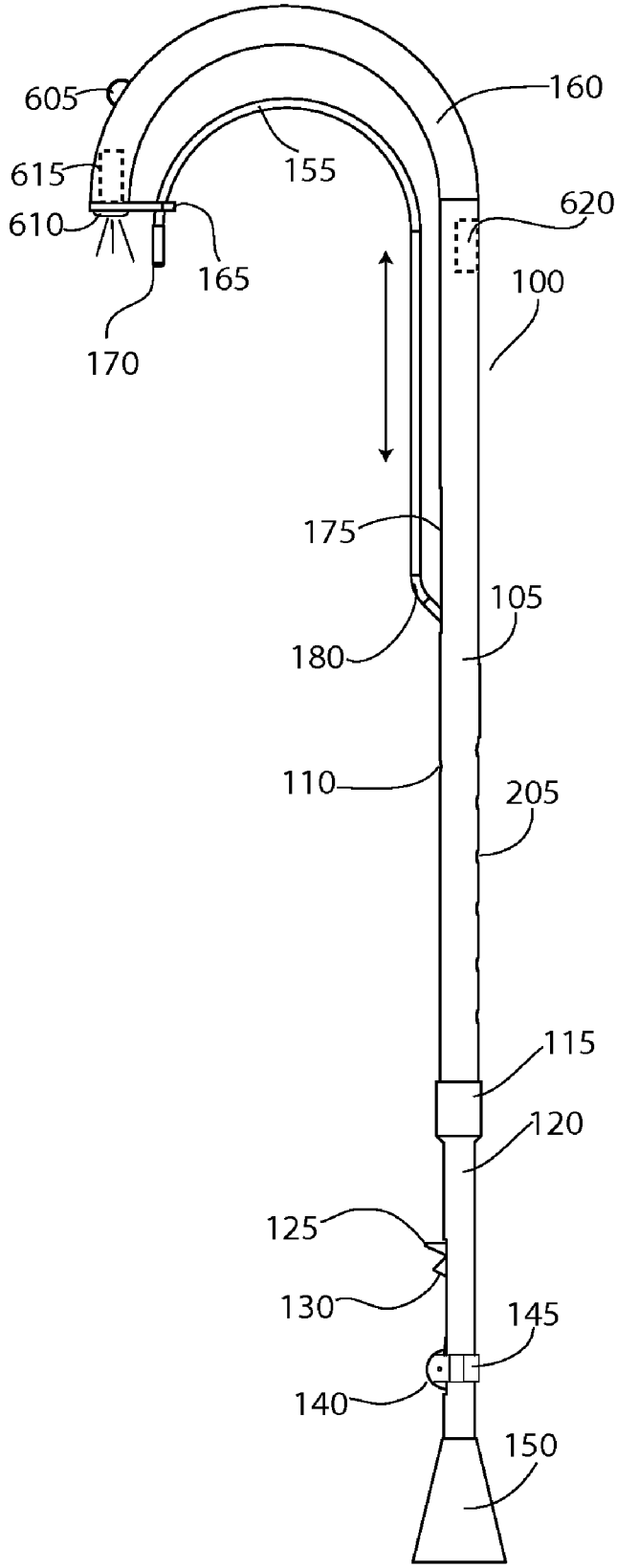
FIG. 6 is side plan side perspective view of an exemplary cane with a handle mounted and actuated light, an inelastic adjustable length linkage, enhanced grasping mechanism, magnetic pickup, hanging tip and self-standing base in accordance with principles of the invention.
Figure 7A:
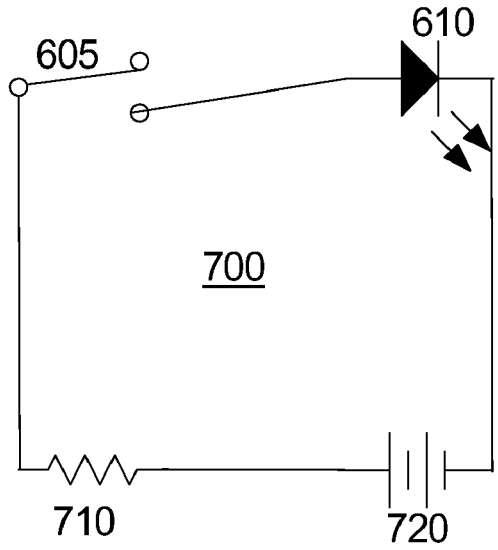
FIG. 7A is a circuit diagram that conceptually illustrates components of an exemplary circuit for a light emitting diode (LED) light source in accordance with the principles of the invention.
Figure 7B:
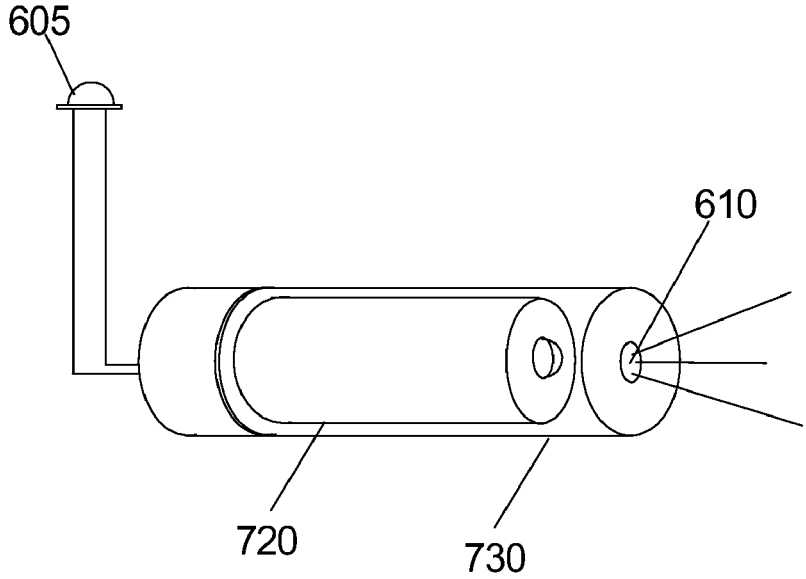
FIG. 7B is a perspective view of an exemplary light module in accordance with the principles of the invention.

Referring to FIG. 6 and to FIGS. 7A and 7B, a light module comprising a container for electronic components, such as a power supply 615, 620 and a light source 610, and a switch 605 are provided on the handle. The electronic components 615 may be located adjacent to the light source 610. Alternatively, some or all of the electronic components 620 may be located in the body of the cane. A portion of the lighting module 615, 620 may be mechanically (e.g., threadedly or frictionally) releasably or permanently secured in a corresponding compartment of the handle using a collet, removable cover or other fastening means. The light module may thus be removed for disposal and replacement, or for repair, such as for replacing batteries. Upon activation, the light source 610 projects light towards the base of the cane.

The switch 605 is operably coupled between the light source 610 and power supply 920 and configured to control activation and deactivation of the light source, as shown in the schematic of FIG. 9A. The switch may be a push button momentary contact switch or any other device suitable for user activation and deactivation of the light module. The switch 605 should be positioned on the handle 160 of the cane 100, easily within reach of a user's thumb and/or index finger. The switch 605 should be easily accessible while a user grips the handle 160 and actuator 155, and should not interfere with use of the actuator 155.

The power supply 720 provides electrical power required to activate the light source 610 when the switch 605 is activated. The power supply 720 may be comprised of one or more disposable or rechargeable batteries contained in a battery compartment 730 in the light module.

A light source 610, such as a light emitting diode (LED), is provided for illumination. The LED 610 emits visible light when a current passes through it in the correct direction. The color, size, shape, and viewing angle of the LED may be selected to achieve satisfactory visibility in a compact, lightweight, energy efficient design. By way of example and not limitation, a miniature (e.g., 5 mm round cross-section) or subminiature (e.g., 3 mm round cross section) LED with a 30° or 60° viewing angle may be utilized. A lens may be provided to promote and/or focus transmission of light from the light source to the base.

Referring now to FIG. 8 a perspective view of an exemplary grasping member 125 in accordance with principles of the invention are provided. The grasping member includes a hub 140, adapted for rotational movement about a central aperture 830. A means 455 (e.g., a screw, shaft or other fastener) for attaching the distal end 455 of the cable 430 is provided. Likewise, a means 435 (e.g., a screw, shaft or other fastener) for attaching the proximal end 435 of the spring 440 is provided. A channel 825 around the periphery of the hub 140 is provided to guide the hub portion 450 of the cable 430. Another channel 820 is provided to guide the spring 440.

The grasping member 125 includes an arm 840 extending radially from the hub 140. Non-slip surfaces 810 such as surfaces having a roughened and/or abrasive finish, are provided to facilitate gripping. A wide intermediate u or v-shaped gripping region 135 is provided. The wide region may feature an opening greater than 2 inches wide that converges to a vertex. Gripping fingers 130, namely 130A and 130B, with rounded tips are provided near the free end 810 of the grasping member 125. The gripping fingers 130A, 130B define a narrow u or v-shaped gripping region 805 that facilitates grasping small objects from the ground. The narrow region may feature an opening less than 1 inch wide that converges to a vertex. A magnet 510, which may be any permanent or electromagnet, facilitates retrieving metallic (e.g., ferrous) objects from the ground.

Figure 9:
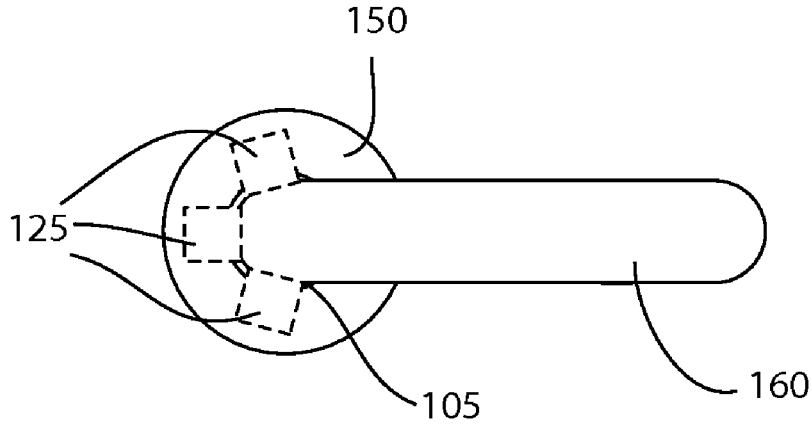
FIG. 9 is a top plan view of an exemplary grasping member according to principles of the invention showing various alternative positions for a grasping claw to maximize utility and visibility for a particular right or left handed user.

Referring now to FIG. 9, the grasping member 125 may be located in any of a variety of clock positions relative to the cane and handle. As conceptually illustrated in the top plan view of FIG. 9, the principles of the invention are not limited to any particular clock position. However, in a preferred embodiment, the position facilitates grasping and visibility.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. An adjustable length manually actuated grasping walking cane comprising a handle, an adjustable length body attached to said handle, said adjustable length body having a distal end, an actuator movably coupled proximate to said handle, said actuator having a distal end, an inelastic adjustable length linkage within the adjustable length body, said inelastic adjustable length linkage having proximal and distal ends, the proximal end of the inelastic adjustable length linkage being attached to the distal end of the actuator, a pivoting grasping member pivotally attached near the distal end of the adjustable length body;

said inelastic adjustable length linkage comprising a fastener assembly, a coupling and a cable, said coupling having distal and proximal ends, and said cable having distal and proximal ends, the fastener assembly adjustably connecting the proximal end of the coupling to the actuator, and the distal end of the coupling being attached to the proximal end of the cable;

said adjustable length body including an access aperture and said fastener assembly being aligned with the access aperture, whereby the fastener assembly is accessible through said aperture and is adjustable to release and allow adjustment of a length of the inelastic adjustable length linkage; and said inelastic adjustable length linkage being operably coupled to said pivoting grasping member and causing the pivoting grasping member to pivot when said actuator is actuated.

2. An adjustable length manually actuated grasping walking cane according to claim 1, wherein said actuator comprises a handle portion configured for actuation by urging towards said handle.

3. An adjustable length manually actuated grasping walking cane according to claim 1, wherein said actuator comprises a handle portion configured for actuation by urging towards said handle, said adjustable length body including an actuator aperture, and said distal end of said actuator being bent and offset to connect to the inelastic adjustable length linkage within the adjustable length body via said actuator aperture.

4. An adjustable length manually actuated grasping walking cane according to claim 1, wherein said actuator comprises a handle portion configured for actuation by urging towards said handle, said adjustable length body including an actuator aperture, and said distal end of said actuator being bent and offset to connect to the inelastic adjustable length linkage within the adjustable length body via said actuator aperture, and the distal end of the cable being attached to the grasping member.

5. An adjustable length manually actuated grasping walking cane according to claim 1, wherein said actuator comprises a handle portion configured for actuation by urging towards said handle, said adjustable length body including an actuator aperture, and said distal end of said actuator being bent and offset to connect to the inelastic adjustable length linkage within the adjustable length body via said actuator aperture, said grasping member including a hub and arm, and the distal end of the cable being attached to the hub of the grasping member and configured to transmit a tensile force from the actuator, through the coupling, through the cable and to the hub of the grasping means, said tensile force causing the grasping means to pivot.

6. An adjustable length manually actuated grasping walking cane according to claim 1, wherein said actuator comprises a handle portion configured for actuation by urging towards said handle, said adjustable length body including an actuator aperture, and said distal end of said actuator being bent and offset to connect to the inelastic adjustable length linkage within the adjustable length body via said actuator aperture, said grasping member including a hub and arm, and the distal end of the cable being attached to the hub of the grasping member and configured to transmit a tensile force from the actuator, through the coupling, through the cable and to the hub of the grasping means, said tensile force causing the grasping means to pivot, said grasping member further including a plurality of grasping fingers protruding from said arm.

7. An adjustable length manually actuated grasping walking cane according to claim 1, wherein said actuator comprises a handle portion configured for actuation by urging towards said handle, said adjustable length body including an actuator aperture, and said distal end of said actuator being bent and offset to connect to the inelastic adjustable length linkage within the adjustable length body via said actuator aperture, said grasping member including a hub and an arm with a free end opposite the hub, and the distal end of the cable being attached to the hub of the grasping member and configured to transmit a tensile force from the actuator, through the coupling, through the cable and to the hub of the grasping means, said tensile force causing the grasping means to pivot, said grasping member further including a pair of grasping fingers protruding from said arm near the free end of the arm in spaced relation and configured to define a generally v-shaped space between said pair of grasping fingers.

8. An adjustable length manually actuated grasping walking cane according to claim 1, wherein said actuator comprises a handle portion configured for actuation by urging towards said handle, said adjustable length body including an actuator aperture, and said distal end of said actuator being bent and offset to connect to the inelastic adjustable length linkage within the adjustable length body via said actuator aperture, said grasping member including a hub and an arm with a free end opposite the hub, and the distal end of the cable being attached to the hub of the grasping member and configured to transmit a tensile force from the actuator, through the coupling, through the cable and to the hub of the grasping means, said tensile force causing the grasping means to pivot, said grasping member further including a pair of grasping fingers protruding from said arm near the free end of the arm in spaced relation and configured to define a generally v-shaped narrow space between said pair of grasping fingers, and further defining a generally v-shaped wide space between said hub and said pair of grasping fingers.

9. An adjustable length manually actuated grasping walking cane according to claim 1, wherein said actuator comprises a handle portion configured for actuation by urging towards said handle, said adjustable length body including an actuator aperture, and said distal end of said actuator being bent and offset to connect to the inelastic adjustable length linkage within the adjustable length body via said actuator aperture, said grasping member including a hub and an arm with a free end opposite the hub, and the distal end of the cable being attached to the hub of the grasping member and configured to transmit a tensile force from the actuator, through the coupling, through the cable and to the hub of the grasping means, said tensile force causing the grasping means to pivot, said grasping member further including a pair of grasping fingers protruding from said arm near the free end of the arm in spaced relation and configured to define a generally v-shaped space between said pair of grasping fingers, and further defining a generally v-shaped space between said hub and said pair of grasping fingers.

10. An adjustable length manually actuated grasping walking cane according to claim 1, wherein said actuator comprises a handle portion configured for actuation by urging towards said handle, said adjustable length body including an actuator aperture, and said distal end of said actuator being bent and offset to connect to the inelastic adjustable length linkage within the adjustable length body via said actuator aperture, said grasping member including a hub and an arm with a free end opposite the hub, and the distal end of the cable being attached to the hub of the grasping member and configured to transmit a tensile force from the actuator, through the coupling, through the cable and to the hub of the grasping means, said tensile force causing the grasping means to pivot, said grasping member further including a pair of grasping fingers protruding from said arm near the free end of the arm in spaced relation and configured to define a generally v-shaped space between said pair of grasping fingers said v-shaped space between said pair of grasping fingers having an opening less than 1 inch, and further defining a generally v-shaped space between said hub and said pair of grasping fingers.

11. An adjustable length manually actuated grasping walking cane according to claim 1, wherein said actuator comprises a handle portion configured for actuation by urging towards said handle, said adjustable length body including an actuator aperture, and said distal end of said actuator being bent and offset to connect to the inelastic adjustable length linkage within the adjustable length body via said actuator aperture, said grasping member including a hub and an arm with a free end opposite the hub, and the distal end of the cable being attached to the hub of the grasping member and configured to transmit a tensile force from the actuator, through the coupling, through the cable and to the hub of the grasping means, said tensile force causing the grasping means to pivot, said grasping member further including a pair of grasping fingers protruding from said arm near the free end of the arm in spaced relation and configured to define a generally v-shaped space between said pair of grasping fingers said v-shaped space between said pair of grasping fingers having an opening less than 1 inch, and further defining a generally v-shaped space between said hub and said pair of grasping fingers, said v-shaped space between said pair of grasping fingers and said hub having an opening greater than 2 inches.

12. An adjustable length manually actuated grasping walking cane according to claim 1, wherein said actuator comprises a handle portion configured for actuation by urging towards said handle, said adjustable length body including an actuator aperture, and said distal end of said actuator being bent and offset to connect to the inelastic adjustable length linkage within the adjustable length body via said actuator aperture, said grasping member including a hub and an arm with a free end opposite the hub, and the distal end of the cable being attached to the hub of the grasping member and configured to transmit a tensile force from the actuator, through the coupling, through the cable and to the hub of the grasping means, said tensile force causing the grasping means to pivot, said grasping member further including a pair of grasping fingers protruding from said arm near the free end of the arm in spaced relation and configured to define a generally u-shaped space between said pair of grasping fingers, and further defining a generally u-shaped space between said hub and said pair of grasping fingers.

13. An adjustable length manually actuated grasping walking cane according to claim 1, wherein said actuator comprises a handle portion configured for actuation by urging towards said handle, said adjustable length body including an actuator aperture, and said distal end of said actuator being bent and offset to connect to the inelastic adjustable length linkage within the adjustable length body via said actuator aperture, said grasping member including a hub and an arm with a free end opposite the hub, and the distal end of the cable being attached to the hub of the grasping member and configured to transmit a tensile force from the actuator, through the coupling, through the cable and to the hub of the grasping means, said tensile force causing the grasping means to pivot, said grasping member further including a magnet configured to attract ferrous materials.

14. An adjustable length manually actuated grasping walking cane according to claim 1, wherein said actuator comprises a handle portion configured for actuation by urging towards said handle, said adjustable length body including an actuator aperture, and said distal end of said actuator being bent and offset to connect to the inelastic adjustable length linkage within the adjustable length body via said actuator aperture, said grasping member including a hub and an arm with a free end opposite the hub, and the distal end of the cable being attached to the hub of the grasping member and configured to transmit a tensile force from the actuator, through the coupling, through the cable and to the hub of the grasping means, said tensile force causing the grasping means to pivot, further including a return spring operably coupled to said hub and configured to urge the grasping member to a closed position.

15. An adjustable length manually actuated grasping walking cane according to claim 1, wherein said actuator comprises a handle portion configured for actuation by urging towards said handle, said handle portion including a free end and an end cover covering said free end, said adjustable length body including an actuator aperture, and said distal end of said actuator being bent and offset to connect to the inelastic adjustable length linkage within the adjustable length body via said actuator aperture, said grasping member including a hub and an arm with a free end opposite the hub, and the distal end of the cable being attached to the hub of the grasping member and configured to transmit a tensile force from the actuator, through the coupling, through the cable and to the hub of the grasping means, said tensile force causing the grasping means to pivot, further including a return spring operably coupled to said hub and configured to urge the grasping member to a closed position.

16. An adjustable length manually actuated grasping walking cane according to claim 1, said handle including a free end and an actuator guide attached to said free end, wherein said actuator comprises a handle portion configured for actuation by urging towards said handle, said handle portion including a free end guided by said actuator guide, said adjustable length body including an actuator aperture, and said distal end of said actuator being bent and offset to connect to the inelastic adjustable length linkage within the adjustable length body via said actuator aperture, said grasping member including a hub and an arm with a free end opposite the hub, and the distal end of the cable being attached to the hub of the grasping member and configured to transmit a tensile force from the actuator, through the coupling, through the cable and to the hub of the grasping means, said tensile force causing the grasping means to pivot, further including a return spring operably coupled to said hub and configured to urge the grasping member to a closed position.

17. An adjustable length manually actuated grasping walking cane according to claim 1, said handle including a free end and an actuator guide attached to said free end, wherein said actuator comprises a handle portion configured for actuation by urging towards said handle, said handle portion including a free end guided by said actuator guide, said adjustable length body including an actuator aperture, and said distal end of said actuator being bent and offset to connect to the inelastic adjustable length linkage within the adjustable length body via said actuator aperture, said grasping member including a hub and an arm with a free end opposite the hub, and the distal end of the cable being attached to the hub of the grasping member and configured to transmit a tensile force from the actuator, through the coupling, through the cable and to the hub of the grasping means, said tensile force causing the grasping means to pivot, further including a return spring operably coupled to said hub and configured to urge the grasping member to a closed position, further including a broad base configured to support the cane upright, said broad base being attached to the distal end of the cane body.

18. An adjustable length manually actuated grasping walking cane according to claim 1, said handle including a free end and an actuator guide attached to said free end, wherein said actuator comprises a handle portion configured for actuation by urging towards said handle, said handle portion including a free end guided by said actuator guide, said adjustable length body including an actuator aperture, and said distal end of said actuator being bent and offset to connect to the inelastic adjustable length linkage within the adjustable length body via said actuator aperture, said grasping member including a hub and an arm with a free end opposite the hub, and the distal end of the cable being attached to the hub of the grasping member and configured to transmit a tensile force from the actuator, through the coupling, through the cable and to the hub of the grasping means, said tensile force causing the grasping means to pivot, further including a return spring operably coupled to said hub and configured to urge the grasping member to a closed position, further including a light source mounted to the free end of the handle and a switch for controlling said light source mounted on said handle.

19. An adjustable length manually actuated grasping walking cane according to claim 1, said handle including a free end and an actuator guide attached to said free end, wherein said actuator comprises a handle portion configured for actuation by urging towards said handle, said handle portion including a free end guided by said actuator guide, said adjustable length body including an actuator aperture, and said distal end of said actuator being bent and offset to connect to the inelastic adjustable length linkage within the adjustable length body via said actuator aperture, said grasping member including a hub and an arm with a free end opposite the hub, and the distal end of the cable being attached to the hub of the grasping member and configured to transmit a tensile force from the actuator, through the coupling, through the cable and to the hub of the grasping means, said tensile force causing the grasping means to pivot, further including a return spring operably coupled to said hub and configured to urge the grasping member to a closed position, further including a light source mounted to the free end of the handle and a switch for controlling said light source mounted on said handle, said grasping member further including a pair of grasping fingers protruding from said arm near the free end of the arm in spaced relation and configured to define a generally v-shaped space between said pair of grasping fingers said v-shaped space between said pair of grasping fingers, and said grasping member having a roughened grasping surface, and said hub including a plurality of cable engaging sections, the plurality of cable engaging sections including a plurality of diameters, which may be selectively used to define a torque and range of actuator motion.

* * * * *